United States Patent [19]

Modesto et al.

[11] 4,043,738

[45] Aug. 23, 1977

[54] VIBRATORY COMPACTING MACHINE

[76] Inventors: Narciso G. Modesto, 585 Crest Court, Lake Forest, Ill. 60045; Robert J. Brejcha, 10657 Preston St., Westchester, Ill. 60153

[21] Appl. No.: 626,708

[22] Filed: Oct. 29, 1975

[51] Int. Cl.[2] ..... B28B 1/08

[52] U.S. Cl. ..... 425/456; 404/103; 404/123; 404/133

[58] Field of Search ..... 425/456, 363, 373, 374; 172/349, 365; 404/103, 123, 133

[56] References Cited

U.S. PATENT DOCUMENTS

| | | | |
|---|---|---|---|
| 625,355 | 5/1899 | Ream | 172/365 |
| 911,848 | 2/1909 | Stroud et al. | 172/365 X |
| 1,102,443 | 7/1914 | Schamell | 404/123 |
| 1,981,788 | 11/1934 | Gardner | 404/123 X |
| 2,025,703 | 12/1935 | Baily et al. | 425/456 X |
| 3,119,313 | 1/1964 | Neidhardt et al. | 404/125 |
| 3,453,940 | 7/1969 | Berkhoudt et al. | 404/133 |
| 3,897,165 | 7/1975 | Varul | 404/133 X |

FOREIGN PATENT DOCUMENTS

| | | | |
|---|---|---|---|
| 2,112,384 | 9/1972 | Germany | 425/456 |

*Primary Examiner*—Richard B. Lazarus
*Attorney, Agent, or Firm*—Mason, Kolehmainen, Rathburn & Wyss

[57] ABSTRACT

A portable vibratory compacting machine for compacting and flattening a poured floor covering. The machine includes a generally horizontal frame including a pair of depending flanges on its opposite sides. A plurality of transversely aligned rollers are rotatably mounted by the longitudinal flanges for contacting the floor and supporting the weight of the machine. A reversible handle is provided so that the machine can be pushed or pulled in either direction, and a vibratory motor is secured to the top of the frame for vibrating the rollers. A plurality of transverse strengthening channels are connected to the frame to evenly distribute the vibratory forces across all of the rollers.

4 Claims, 5 Drawing Figures

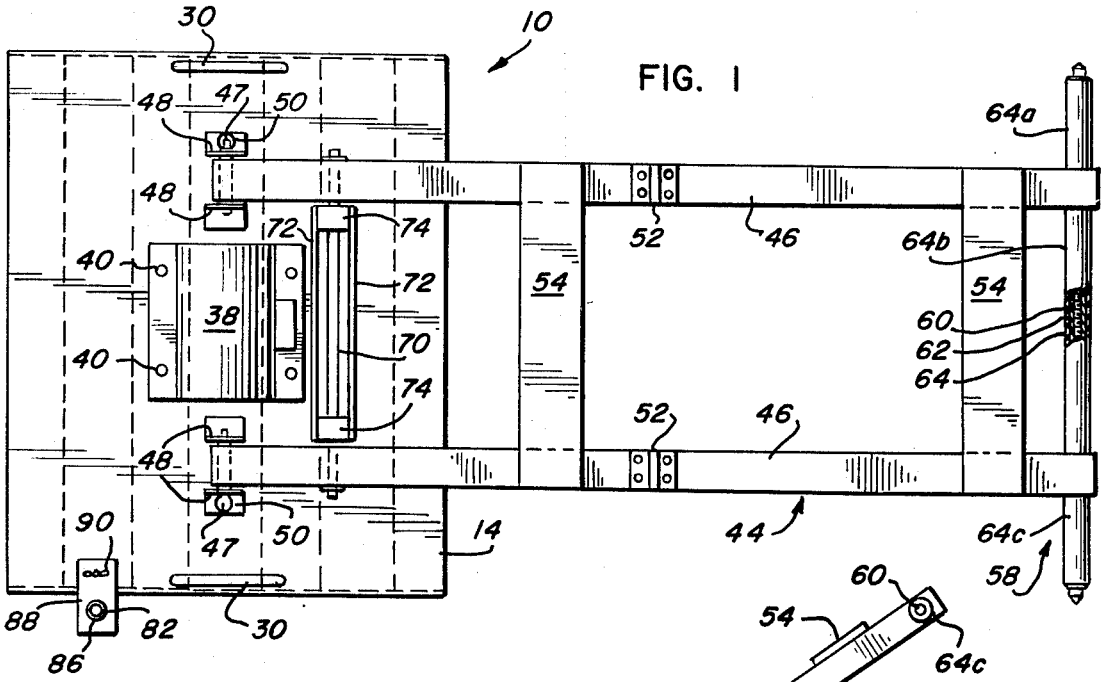
FIG. 1
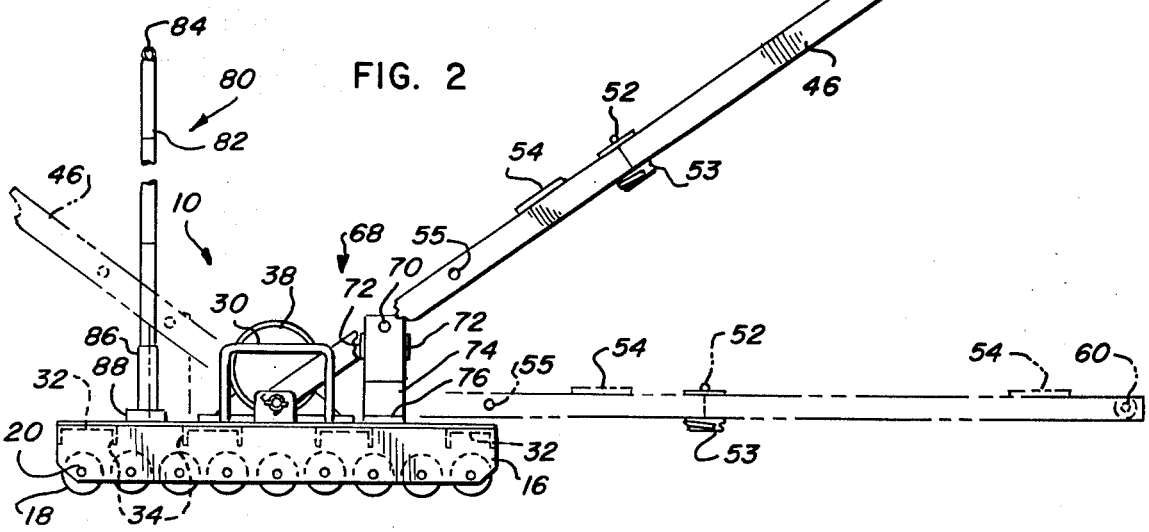
FIG. 2
FIG. 4A
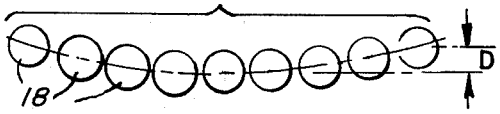
FIG. 4B
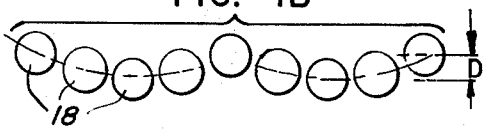
FIG. 3
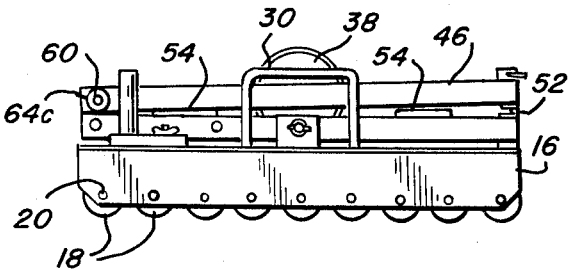

VIBRATORY COMPACTING MACHINE

BACKGROUND OF THE INVENTION

1. Field of the Invention

A portable vibratory machine for compacting and leveling a layer of fluid floor covering as it is moved thereover.

2. Description of the Prior Art

Numerous machines have been proposed and used in the past to smooth or finish the surface of a freshly poured floor covering such as concrete or the like, as well as to compact the material. Such equipment has often been very heavy and cumbersome and not adapted for use on areas such as sidewalks and hallways. Additionally, it was often necessary to make many passes over the surface with the machine in order to derive a smooth surface while completely eliminating any air pockets within the floor covering. The present invention overcomes these advantages by providing a portable, manually operable compacting machine to concurrently vibrate the material and smooth the surface in a shorter period of time.

SUMMARY OF THE INVENTION

A vibratory compacting machine for compacting and leveling a poured floor covering such as terrazzo or the like is provided and includes a generally horizontal frame having two depending longitudinal flanges on the opposite sides thereof. A plurality of transversely aligned rollers are rotatably mounted by the flanges for contacting the floor covering and supporting the weight of the machine. A foldable reversible handle is provided so that the machine may be moved easily in opposite directions. A single vibratory motor is secured to the frame and transmits vibratory compacting forces to the rollers. A plurality of transverse strengthening channels are secured to the underside of the frame to evenly distribute the vibratory forces to the rollers. The rollers may be mounted in a single plane or in a curved, generally downwardly convex relationship.

BRIEF DESCRIPTION OF THE DRAWINGS

FIG. 1 is a top plan view of a vibratory compacting machine embodying the concepts of the present invention;

FIG. 2 is a side elevational view of the machine of FIG. 1, showing multiple positions of the handle;

FIG. 3 is a side elevational view, similar to FIG. 2, showing the handle folded for storage; and FIGS. 4A and 4B are schematic views of alternate roller mounting relationships.

DETAILED DESCRIPTION OF THE PREFERRED EMBODIMENT

A vibratory compacting machine, generally designated 10 (FIGS. 1 and 2), embodying the concepts of the present invention includes a generally flat, rectangular frame plate 14 fabricated of steel or other suitable material. A pair of depending, longitudinal flanges (FIGS. 2 and 3) are provided on opposite sides of the frame plate 14 for mounting a plurality of rollers 18. The rollers 18 each are independently rotatably mounted by appropriate bores 20 in the flanges 18. Preferably, the rollers 18 are of a conventional type having internal sealed bearings mounting the cylindrical roller portion on an axle. A spring biased end (not shown) on each of the axles permits easy insertion and removal of the rollers 18 from the machine for cleaning or replacement. The rollers 18 may be aligned by the respective bores 20 in a single plane as shown in FIG. 3. Alternatively, the rollers 18 may be arranged in a generally arcuate downwardly convex path as shown in FIG. 4A. The distance D between the centerline of the endmost roller and central lowermost roller can range approximately from 1/64 to ¼ of an inch when the rollers are, for instance, 2-½ inches in diameter. A third variation in the arrangement of the rollers is shown in FIG. 4B. In this arrangement, the end and centermost roller centerlines lie in the same plane while the remaining rollers lie on a pair of downwardly convex curves. Again, the distance D between the end rollers and the lowermost roller can range from approximately 1/64 to ¼ of an inch. Of course, these dimensions would vary greatly depending upon the size of the rollers and the machine.

The vibratory compacting machine 10 is designed to be a portable device and therefore a pair of appropriate U-shaped carrying handles 30 are provided on opposite sides of the frame plate to facilitate carrying of the machine.

A plurality of transverse U-shaped strengthening ribs 32 (FIG. 2) are securely fastened, for example by welding, to the underside of the frame plate 14 to add rigidity to the plate, as will be described in detail hereinafter. Each of the support ribs 32 comprises a channel having a pair of downwardly directed wall portions 34.

Vibratory means is provided in the form of a conventional vibratory motor 38 mounted to the top of the frame plate 14 by a plurality of bolts 40, or the like. The vibratory motor is of the eccentric weight or electromagnetic type for imparting reciprocal vibratory forces to the entire unit. The strengthening ribs 32 described above serve to facilitate distributing the vibratory forces over the plurality of rollers 18 for distribution of compacting forces to the layer of floor coverng and to additionally aid in leveling or smoothing of its surface. FIGS. 4A and 4B show specific configurations which concentrate energy at the lowermost points of the respective curves.

The machine 10 is designed for one man operation in opposite directions and a reversible handle, generally designated 44, is pivotally connected to the frame plate 14 so that it can be pivoted from one side to the other to facilitate reversing the direction of travel. The handle 44 is generally T-shaped and include a pair of elongated generally square cross sectional arms 46. The arms are pivotally connected by a pin 47 between a pair of upstanding flanges 48 provided on the top of the frame plate 14. Each pin 47 includes a pull ring 50 and detent means in the form of a spring biased ball (not shown) to facilitate removal of the pins from the flanges 48 to disconnect the handle 44. Additionally, the elongated arms 46 have hinges 52 at approximately their midpoints to permit folding or collapsing of the arms onto one another for storage on top of the frame plate 14 as shown in FIG. 3. A clamp 53 maintains the arms in their open position. When the handle 44 is folded and placed on the base plate 14, the pins 47 can be reinserted through holes 55 midway along the length of the lower arms 46. A pair of connector braces 54 are secured between the respective portions of the elongated arms and serve to add rigidity and strength to the handle 44.

A top cross bar, generally designated 58, is secured at the upper, free end of the handle 44 for manual grasping by the user. The cross bar 58 includes an inner threaded shaft 60 which is enclosed by a rotatable metal sleeve 62. An outer three part rubber sleeve 64A–64C is wrapped about the metal sleeve 62 and facilitates absorbing some of the vibrations from the motor 38.

A support leg structure, generally designated 68, is pivotally mounted by a shaft 70 between the elongated arms 46 to support the handle 44 at the desired angle for the user, as shown in FIG. 2. The leg structure 68 includes a pair of cross braces 72 which are connected to the shaft 70 by a pair of vertical end feet 74. A suitable resilient or rubberized base 76 is provided on the bottom of each of the feet 74 to further reduce the amount of vibrations transmitted through the handle to the operator.

A "flag pole", generally designated 80 is provided to support the electrical supply cord well above the surface of the machine 10 and to prevent the cord from dragging on the floor. The flag pole 80 includes a vertical, fragmented pipe 82 which extends approximately eight feet above the top of the frame plate 14 and a ring 84 on the top thereof through which the electrical cord is passed and suspended. The sectional pipe 82 is preferably manufactured of four lengths, each being approximately two feet long so that they can be disassembled and stored on top of the frame plate 14. The vertical pipe 82 is received within a short base pipe 86 of slightly larger internal diameter than the pipe 82 so that it can be easily removed for storage. The base pipe 86 is mounted by a pivotal block 88 which is pivotally mounted and secured to the base plate 14 by a bolt and wing nut 90. When in use, the flag pole 80 is pivoted to a position outside the perimeter of the base plate 14 (as shown in FIGS. 1 and 2) so that the handle 44 may be pivoted back and forth without interfering with the elongated vertical pipe 82. The flag pole, when collapsing the machine for storage, is pivoted to a position so that the mounting block 88 is generally parallel with the edge of the base plate 14 and again locked by the wing nut 90 as shown in FIG. 3.

When the handle 44 and the flag pole 80 are disassembled or collapsed for storage, both the sections of the flag pole and the two collapsible lengths of the handle 44 will lay on top of the base plate 14 within the confines of the perimeter of the base plate to facilitate storage. Additionally, the weight of the handle and flag pole sections are evenly balanced about a general mid-longitudinal centerline of the base plate so that the machine can be easily carried by the handles 30 when in the collapsed position.

As described, the vibratory compacting machine 10 of the present invention provides a vibratory force which permits the installation of a terrazzo floor covering, concrete, or the like, in a shorter period than is normally required. The machine 10 permits the use of a dryer mix which will, when set, provide a harder, stronger floor and the vibratory forces also serve to float the marble or other aggregates within the terrazzo floor or other system to the top surface to provide a more pleasing and aesthetic finished product. The plurality of rollers 18 also will provide a flatter and smoother surface so that less grinding, or less trowelling when the finished product is trowelled, will be necessary in order to finish the surface. The collapsible nature of the particular handle reduces set up time and also makes a convenient small, portable device which can easily be moved from various construction sights, while requiring a minimum of space.

The foregoing detailed description has been given for clearness of understanding only and no unnecessary limitations should be understood therefrom as some modifications will be obvious to those skilled in the art.

We claim:

1. A machine for compacting and leveling a poured floor covering, comprising:

a generally horizontal frame having depending roller journal means on opposite sides thereof;

vibratory means securely connected to the frame; and a plurality of elongated rollers rotatably mounted at their ends to said journal means and extending therebetween for contacting the floor covering and supporting the weight of the machine for movement thereover, said rollers being mounted on said journal means with their centerlines lying on a generally downwardly directed, convex line generally perpendicular to the centerlines of the rollers so that the centermost roller is lower than the two endmost rollers and the intermediate rollers are proportionately positioned therebetween.

2. The machine of claim 1 wherein said rollers are mounted on said journal means with their centerlines lying in a plurality of said downwardly directed merging convex lines generally perpendicular to the centerlines of the rollers so that the end and at least one intermediate roller lie in a common horizontal plane with the remaining rollers positioned at appropriately proportioned lower planes.

3. A machine for compacting and leveling a poured floor covering, comprising:

a generally horizontal frame having depending journal means on two opposite sides thereof;

a plurality of generally transverse rollers rotatably mounted between said journal means for contacting the floor covering and supporting the weight of the machine for movement thereof, said rollers being disposed between said journal means with their centerlines lying in a generally downwardly directed, convex line generally perpendicular to the centerlines of the rollers so that the centermost roller is loer than the two end rollers and the intermediate rollers are proportionately positioned therebetween; and vibratory means securely connected to the frame.

4. A machine for compacting and leveling a poured floor covering, comprising:

a generally horizontal frame having depending journal means on two opposite sides thereof;

a plurality of generally transverse rollers rotatably mounted between said journal means for contacting the floor covering and supporting the weight of the machine for movement thereof, said rollers being disposed between said journal means with their centerlines lying in a plurality of generally downwardly directed merging convex lines generally perpendicular to the centerlines of the rollers so that the two end rollers and at least one intermediate roller lie in one horizontal plane with the remaining rollers positioned at appropriately proportioned lower planes; and the vibratory means securely connected to the frame.

* * * * *

UNITED STATES PATENT AND TRADEMARK OFFICE

CERTIFICATE OF CORRECTION

PATENT NO. : 4,043,738

DATED : August 23rd, 1977

INVENTOR(S) : NARCISO G. MODESTO et al

It is certified that error appears in the above-identified patent and that said Letters Patent are hereby corrected as shown below:

Column 1, line 20, delete "advantages" and insert therefor --disadvantages--.

Column 2, line 38, delete "coverng" and insert therefor --covering--. Same column, line 48, delete "include" and insert therefor --includes--.

Column 4, line 44, delete "loer" and insert therefor --lower--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*